US006406592B2

(12) United States Patent
Leskelä et al.

(10) Patent No.: US 6,406,592 B2
(45) Date of Patent: Jun. 18, 2002

(54) PROCESS FOR PREPARING BASE PAPER FOR FINE PAPER

(75) Inventors: Markku Leskelä, Lohja as.; Kaarlo Johannes Niskanen, Porvoo; Stina Nygård, Lohja as.; Maija Pitkänen, Jyväskylä, all of (FI)

(73) Assignee: M-real Oyj, Espoo (FI)

( * ) Notice: Subject to any disclaimer, the term of this patent is extended or adjusted under 35 U.S.C. 154(b) by 0 days.

(21) Appl. No.: 09/154,157

(22) Filed: Sep. 16, 1998

(30) Foreign Application Priority Data

Sep. 16, 1997 (FI) ..... 973706

(51) Int. Cl.[7] ..... D21H 11/10; D21H 19/00

(52) U.S. Cl. ..... 162/142; 162/141; 162/135; 162/147; 162/149

(58) Field of Search ..... 162/135, 142, 162/149, 91, 141, 147

(56) References Cited

U.S. PATENT DOCUMENTS

| | | | | | |
|---|---|---|---|---|---|
| 1,624,492 | A | * | 4/1927 | Little et al. | 162/142 |
| 1,824,837 | A | * | 9/1931 | Richter | 162/149 |
| 4,388,150 | A | * | 6/1983 | Sunden et al. | 162/175 |
| 5,118,533 | A | | 6/1992 | Saji et al. | 427/366 |
| 5,158,806 | A | | 10/1992 | Unger | 427/359 |

FOREIGN PATENT DOCUMENTS

| | | |
|---|---|---|
| DE | 44 11 987 A1 | 10/1995 |
| EP | 0 496 269 | 7/1992 |
| FI | 884196 | 3/1989 |
| FI | 961026 | 9/1997 |
| GB | 496 775 | 12/1938 |
| GB | 1 001 778 | 8/1965 |
| GB | 1 030 195 | 5/1966 |
| GB | 2 262 542 A | 6/1993 |
| WO | WO 95/28522 | 10/1995 |

OTHER PUBLICATIONS

Barzyk, D., et al., "Acidic Group Topochemistry and Fibre–to–Fibre Specific Bond Strength," *J. Pulp Paper Sci.* 23(2):J59–J61 (Feb. 1997).

Dahlvik, P., et al., "Interactions in Coating Colors Induced by Temperature–Sensitive Cellulosic Polymer," *Intl. Paper and Coating Chem. Symp.*, Ottawa, Canada, pp. 155–162 (Jun. 1996).

Malinen, R., "Recent trends in kraft pulping in Finland," *Paper and Timber* 75(1–2):14–19 (1993).

Sundberg, K., et al., "Interactions between simple electrolytes and dissolved and colloidal substances in mechanical pulp," *Pulp Paper Res. J.* 9(2):125–128 (1994).

European Search Report for European Application No. EP 98 66 0001.3.

Patent for Inventions, Abridgments of Specifications, Herlad Printing Works, York, 1954, Abstract for U.K. Patent No. 623,357, p. 39.

Patent for Inventions, Abridgments of Specifications, Herlad Printing Works, York, 1954, Abstract for U.K. Patent No. 609,927, pp. 141–142.

Dialog File 351 (World Patents Index) English language abstract of FI 884196, WPI Accession No. 89–087231/12.

English language Abstract of FI 961026 (Document AN2).

English language Abstract of DE 44 11 987 A1 (Document A02).

Abstract for Karenlampi, P., "Tensile Strength of a Mixture of Two Pulps," *J. Pulp Pap. Sci.* 21(12):J432–436 (1995).

* cited by examiner

*Primary Examiner*—Jose Fortuna
(74) *Attorney, Agent, or Firm*—Kubovcik & Kubovcik

(57) ABSTRACT

The present invention concerns a method for producing a base paper for fine papers, the base paper being produced from a mixture of a mechanical pulp and a chemical pulp. The chemical pulp used comprises a chemical softwood pulp having a elastic modulus close to that of the mechanical pulp and a great bonding strength. It is preferred to use a chemical softwood pulp which produces a sheet having a elastic modulus of less than 6000 N/mm$^2$ when the bonding strength is 400 J/m$^2$. A pulp of this kind has a good ScottBond strength at the same light scattering. The base paper produced by the method can therefore be used in double-coated fine papers which require a large bonding strength of the base paper.

17 Claims, 3 Drawing Sheets

PROCESS FOR PREPARING BASE PAPER FOR FINE PAPER

BACKGROUND OF THE INVENTION

Field of the Invention

The present invention concerns a process for preparing a base paper that can be used as base paper in particular for manufacturing coated fine papers or printing paperboards. A paper or paperboard of this kind comprises bleached chemical pulp.

The present invention also concerns a base paper for fine papers and a process for manufacturing fine paper.

The special problem of coated, in particular double-coated, fine papers is that the paper web tends to split in the dryer of the printing machine when water from the printing colour and similar solvents are removed by drying. The problem is caused by the fact that double-coating forms on the source of the paper a very dense coating layer which cannot be penetrated by steam vapourizmg from the base paper. The steam primarily stems from the normal 4 to 5% moisture content of paper and the bubbles formed from the moisture break the paper, if the strength properties of the base paper are not sufficient for resisting this steam pressure.

The aforedescribed problem is called blistering and the required internal bond strength (z-directional strength) of the paper is measured by the ScottBond value.

Traditionally, a reduction of the blistering of the base paper of fine papers has been aimed at by increasing the beating of the chemical pulp, in order to obtain more bonds between the fibers. This solution comprises the disadvantage that an increase of the beating does not enhance the bonding strength expressed by the ratio of strength-to-bonding surface area. Increased beating causes a number of problems. First, when the beating is increased, dewatering of paper is impaired. Therefore, the water content of the paper is disadvantageously high when the paper after web forming is transferred to the wet press section of the paper machine and then onwards to the drying section. As a result, it becomes more likely that the paper will adhere to the rollers of the wet press and drying sections, and the risk of web breaks increases. Further, the strength of the web is small at higher water contents and this already increases the risk of web breaks.

Secondly, also the properties of dry paper change in a an undesireable way if the pulp is subjected to extensive beating. When the beating is increased the density of the paper grows and as a result the stiffness of the paper decreases. This causes runability problems in the paper machine due to wavy edges. When paper density grows, the fibers of the chemical pulp are more arid more tightly bonded so that the elastic modulus increases. Then the paper becomes brittle and and its toughness is not sufficient to meet the strain caused by the paper and printing machines.

It should be mentioned that the unsufficient internal bond strength of paper causes problems also during sheet offset printing although no separate dryer is used in that printing technique. In sheet offset printing the problem is formed because the printing colours are sticky. When the paper is released from the printing nip, the surface of the paper and the wet printing colour are stuck together. If the internal bond strength of the paper is not large enough in comparison to the internal cohesion forces of the printing colour, the surface of the paper will accompany the printing colour and the paper will split in the middle of the sheet. Increased beating of the chemical pulp has been used in attempts to solve this problem also.

BRIEF SUMMARY OF THE INVENTION

It is an object of the present invention to eliminate the problems of the prior art and to provide an entirely novel method for producing a paper web which can be used as a base web for coated fine papers. In particular it is an object of the present invention to provide a paper web having excellent formation and with a capacity of forming particularly strong bonds.

The present invention is based on the idea of forming the base paper from a mixture of mechanical and chemical pulp, the chemical pulp used comprising a chemical softwood pulp incorporating in combination a large ScottBond strength and a elastic modulus which is relatively small for chemical softwood pulp. Preferably the elastic modulus is less than 6000 $N/mm^2$, when the ScottBond-strength of the chemical pulp is 400 $J/m^2$. Thus, a paper produced from a mixture of mechanical pulp and chemical pulp will simultaneously have high ScottBond strength and large toughness.

More specifically, the solution according to the present invention is a process for producing base paper for fine paper, wherein the base paper is produced from a mixture of mechanical pulp and chemical pulp, whereby the chemical pulp used comprises softwood pulp having an elastic modulus which is close to the elastic modulus of elasticity of the mechanical pulp and exhibiting a large bonding strength.

Considerable advantages are obtained by the present invention. Thus, the pulp produced according to the invention has at the same amount of surface bonding, i.e. at the same light scattering, a better bonding strength than comparative pulps. The present base paper can therefore be used for production of double-coated fine papers which in particular require greater bonding strength of the base paper. Other fiber components whose internal bond strength in itself is not sufficient can be incorporated into the base paper. As a specific example reference can be made to the manufacture of fine paper from mixtures of aspen groundwood and chemical softwood pulp, whereby a strong paper is obtained as a finished product, said paper having good brightness and opacity and a very smooth surface. Thanks to the good bonding strength of the chemical softwood pulp, aspen groundwood can be used even in amounts up to 20 to 60% of the dry matter of the pulp.

The technical solution according to the present invention comprises using a chemical pulp which has been produced by chemical pulping which will protect the fibers, whereby their strength remains good. The cooking should be selective in the sense that it selectively removes lignin and spares the carbohydrates of the fiber. In connection with the present invention it has been found that these objects can be obtained by using batch cooking, a particularly preferred embodiment comprising extended batch cooling (SuperBatch™ cooking). SuperBatch™ (Trademark of Sunds Defibrator). The superbatch method is a modified batch method in which one or more SuperBatch™ digesters are used to prepare pulp. The superbatch method is a method in which hot cooking liquor is fed to the chips from the bottom of the digester. The hot cooking liquor is then circulated, with or without a heat exchanger, and steam is added to the liquor to raise the temperature thereof. After the desired defibration point is reached, the hot cooking liquor is displaced by warm liquor. The digested pulp is discharged from the SuperBatch™ digester by pumping.

As regards the strength of the chemical pulp, the pulping method is not as such a sufficient criterion, but the chemical pulp produced according to the invention should have enough bonds between the fibers. In connection with the present invention is has been found that by bleaching softwood pulp produced by batch cooking with chlorine free (TCF) bleaching comprising bleaching stages with peroxide and ozone particularly good strength properties are obtained. Said oxidizing chemicals form carboxylic groups on the fibers and these groups improve the strength of the bleached pulp.

The importance of the acid groups for forming bonds between the fibers has been discussed in Barzyk, D. et al. Journal of Pulp and Paper Science, 23 (1997) J59–J61. According to that article the bonding strength is based on carboxylic groups. In the present invention it has, however, been found that it is not only the amount of acid groups that is decisive, but the conditions of the cook and the bleaching sequences are also of importance.

As discussed above, when attempts are made to regulate the properties of the pulp by beating, i.e. when the ScottBond is raised by a high degree of beating, the chemical pulp and, e.g., hardwood groundwood, will get very different elastic moduli (chemical pulp gets very high stiffness), which is undesirable as far as the toughness of a mixture produced of these pulps is concerned. This problem is not encountered in the present invention. For this reason, by means of the present invention, a mire of hardwood groundwood and chemical pulp is obtained which is excellent as a base paper of fine papers.

According to a preferred embodiment, the chemical pulp used for preparing a base paper is produced by a cooking method known as a modified batch-type cook (SuperBath™ Cook). This cook is described in the literature [cf. for example Malinen, R. Paperi ja Puu (Paper and Timber), 75 (1993) 14–18]. The cook in question is a modified cooking method which utilizes an alkaline cooking liquor just as the sulphate cook, but wherein delignification has been enhanced so that the kappa number of the chemical pulp is lowered without a significant reduction of viscosity. Typically with a Superbatch process, pulp is cooked to a kappa number of 20 or less.

According to a preferred embodiment of the present invention, a softwood pulp produced by batch cooking is bleached with TCF bleaching. The following examples of suitable bleaching sequences can be mentioned:

(Q)-O-Z-P-Z-P (Q)-O-Z-E-$P_n$

O-(Q)-Z-E-P-Z-E-P

O-Z-(Q)-$P_n$

O-X-Z-$P_n$

O=oxygen treatment

P=peroxide treatment $P_n$=several successive peroxide treatment stages

E=alkali step

Q=treatment with complexing agent

X=enzyme treatment

An acid pretreatment at elevated temperature (an A stage) can be performed between the oxygen delignification (O-stage) and a bleaching step carried out with an oxidizing chemical (i.e. a Z-stage).

It is particularly preferred to carry out the bleaching of the pulp with two ozone stages and at least two peroxide stages. Between the stages carried out with oxidizing chemicals, it is possible to extract the pulp during various alkaline stages (such as E and E0) and/or to wash it with water.

Following the above-described treatment a pulp is obtained having an internal bond strength which is better than that of comparative pulps. It typically contains at least 40 mmol carboxylic acid groups/kg dry pulp. Preferably the elastic modulus of the chemical pulp used according to the present invention is below 6000 N/mm$^2$, in particular below 5000 N/mm$^2$ when ScottBond strength is 400 J/m$^2$.

As mentioned above, the base paper can be produced from chemical pulp by combining it with aspen groundwood, by slushing the obtained fibrous base material, by forming a web from the stock and by drying the web on a paper machine in order to form a base paper. Generally, the pulp can be produced from any mechanical pulp made of a tree of the Populas family. Suitable species are, for example, *P. tremula, P. tremuloides, P balsamea, P. balsamifera, P. trichocarpa* and *P. heterophylla*. A preferred embodiment comprises using aspen (trembling aspen, *P. tremula*; an aspen known as Canadian aspen, *P. tremuloides*), or aspen varieties known as hybride aspens produced from different base aspens by hybridizing as well as other species produced by recombinant technology, or poplar. It is preferred to use groundwood (GW), pressure groundwood (PGW) or thermomechanical pulp (TMP) manufactured from aspen, hydride aspen or poplar.

Preferably the mechanical aspen pulp contains about 10 to 20% of +20 . . . +48 mesh fibers, which confer mechanical strength to the pulp. In order to maximize light scattering, the portion of +100, +200 and −200 fractions should be as large as possible. Preferably they stand for distinctly more than 50% of the whole pulp. In particular their proportion of the whole pulp is over 70%, preferably over 80%. On the other hand, the amount of the smallest fraction, i.e. the −200 mesh, should not be too large, because then dewatering on the paper machine would become more difficult. Preferably the proportion of this fraction is smaller than 50%, in particular 45% or less Due to the excellent mechanical properties of the pulp according to the present invention the proportion of the mechanical pulp can be even up to 70 weight-% of the dry matter of the stock without the strength of the paper essentially suffering. Typicaly, the proportion of the mechanical pulp is at least 20% and in particular it is 30 to 60 weight-%.

Based on what is stated above, according to the invention the composition of a particularly preferred base paper is the following: 30 to 60 weight-% of the fibrous matter comprises mechanical pulp produced from aspen and 70 to 40 weight-% comprises softwood chemical pulp. The ScottBond strength of the chemical softwood (in particular pine) pulp is at least 400 J/m$^2$ at a light scattering coefficient of 22 m$^2$/kg and it contains at least 40 mmol carboxylic acid groups/kg dry pulp.

From the base paper according to the present invention it is possible to produce high-quality fine paper by coating it preferably twice, the first coating for example being carried out by a method known as the film press method, and the second coating is performed by blade coating. The amount of coating colour applied to the web by the film press method is typically about 5 to 50 g coating colour/m$^2$, whereas the corresponding amount for doctor blade coating is 10 to 60 g coating colour/m$^2$. The indicated amounts of coating have been calculated from the dry matter of the coating colour.

Next, the invention will be examined more closely with the aid of a detailed description and with reference to the attached drawings and working examples.

DETAILED DESCRIPTION OF THE INVENTION

The following measurement standards have been used in the examples:

ISO brightness of the chemical pulp: SCAN-C'M 11 and SCAN-P3 light scattering coefficient: SCAN-C 27

ScottBond strength: Tappi T833 brightness: SCAN-P3:93 (D65/10°)

opacity: SCAN-P8:93 (C/2)

surface coarseness: SCAN-P76:95

Bendtsen coarseness: SCAN-P21:67 gloss: Tappi T480 (75°) and T653 (20°)

elastic modulus measurement: SCAN-P 38 (strip size and tensile velocity).

For measurement of the elastic modulus the sheet was prepared and the drying was carried out according to standard SCAN-C 26.

EXAMPLE 1

Internal Bond Strength of Chemical Pulps

The ScottBond strength of sheet produced from softwood chemical pulp is influenced by the extent of bonding surface between the fibres and the strength of the bonds. The amount of the bonding surface is, on its part, strongly dependent on the degree of beating of the chemical pulp used in sheet-making. When beating is increased the bonding area and at the same time the bonding strength are increased. To make it possible to compare bond strengths, in this example the internal bond strengths of different chemical pulps are compared by examining them as a function of the light scattering coefficient in the same way as in the article by Barzyk et al. Journal of Pulp and Paper Science, 23 (1997) J59–J61, FIGS. 3 and 4, already referred to above. It is conceivable that with chemical softwood pulps the light scattering coefficient is a measure of the amount of bonding surface of the fibers, the greater the amount of bonding surface the smaller the light scattering coefficient.

Figure 1:
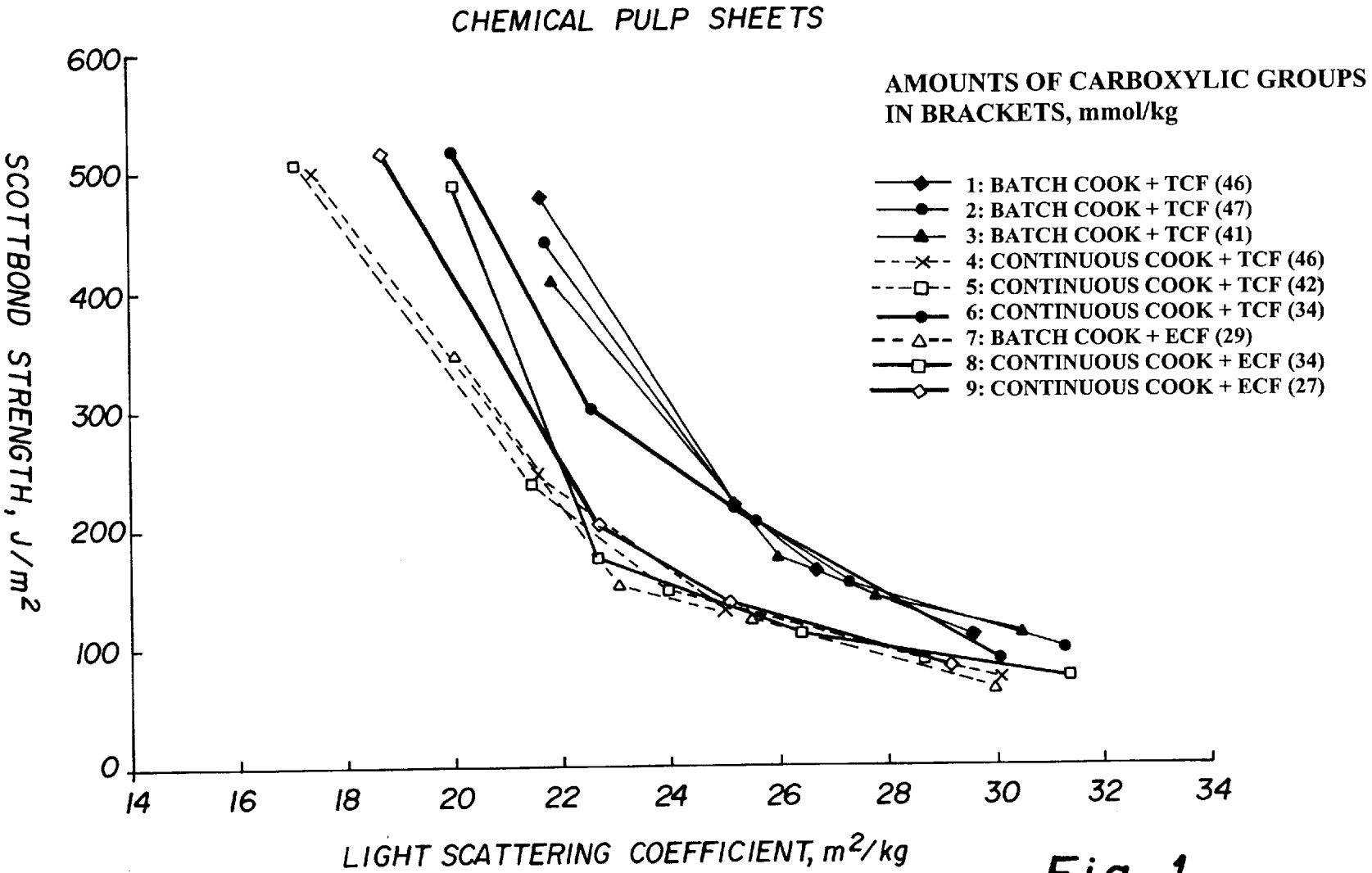
FIG. 1 compares the pulps disclosed in the examples; the ScottBond strength is indicated on the y axis as a function of the light scattering coefficient, FIG. 2 indicates the ScottBond strengths of three mixed sheets as a function of the light scattering coefficient, and FIG. 3 contains a comparison of the elastic moduli of four chemical pulps as a function of internal bond strength.

In this test the internal bond strength and light scattering coefficient of chemical pulps have been modified by beating the pulps in an Escher-Wyss-refiner at various energy amounts of 0 to 200 kWh/ton. The specific edge load of the beating was 3 Ws/m. The results are indicated in FIG. 1. In that Figure, the curve extending to a higher level at the same amount of bonding surface, i.e. light scattering, stands for an increased bonding strength.

Graphs 1 to 3 depict cellulosic pulps produced by a continued batch cooking (Super-Batch) which have been subjected to chlorine-free bleaching (TCF) by using two ozone and two peroxide stages (ZPZP). Graphs 4 and 5 depict a pulp produced by a continuous cooking method, which also has been subjected to chlorine-free bleaching (TCF) by using one ozone and one peroxide stage (ZP). The cooking result is, compared to the above mentioned batch cooking, more hetrogenous and weaker fibers are produced. The fiber collapses more easily, and it looses its light scattering coefficient which moves the curve to the left. The pulps produced by both methods 1 to 3 and 4 and 5 contain at least approximately an equal amounts of carboxylic acid groups (41–47 mekv./kg and 42–46 mekv./kg, respectively).

Graphs 6 to 9 show pulps which have been subjected to a bleaching without elemental chlorine (ECF bleaching). The starting material of cooking 6 was a raw material obtainable in the north of Finland. It comprises small size fibers which give a large specific surface ($m^2$/g fiber) and, therefore, it light scattering coefficient is good. The concentration of carboxylic acid groups was 34 mekv./kg. The raw material of cooking 7 was obtained from Eastern Finland and the chemical pulp had been produced by batch cooking, Graphs 8 and 9 represent the internal bonding strength of pulps produced by continuous cooking and bleached by ECF bleaching. The concentration of caboxylic groups was 27 to 34 mekv./kg. The graphs show that pulps 1 to 3 give greater values for the bonding strength than the other pulps at the same light scattering coefficient. The differences become more pronounced when the pulp have been subjected to extended beating.

Next, three of the afore-mentioned pulps were selected for a sheet forming test. Although the pulps were not from the same batches as above, pulp A corresponded to pulps 1 to 3, pulp B corresponded to pulp 6 and pulp C corresponded to pulp 7. The pulps were refined in a laboratory Valley beater so that the degree of beating (drainage) was CSF 380 ml. Then sheets were produced from the pulps so that in each test point the sheets contained 60% chemical pulp and 40% aspen PGW pulp (aspen of Populus family).

Figure 2:
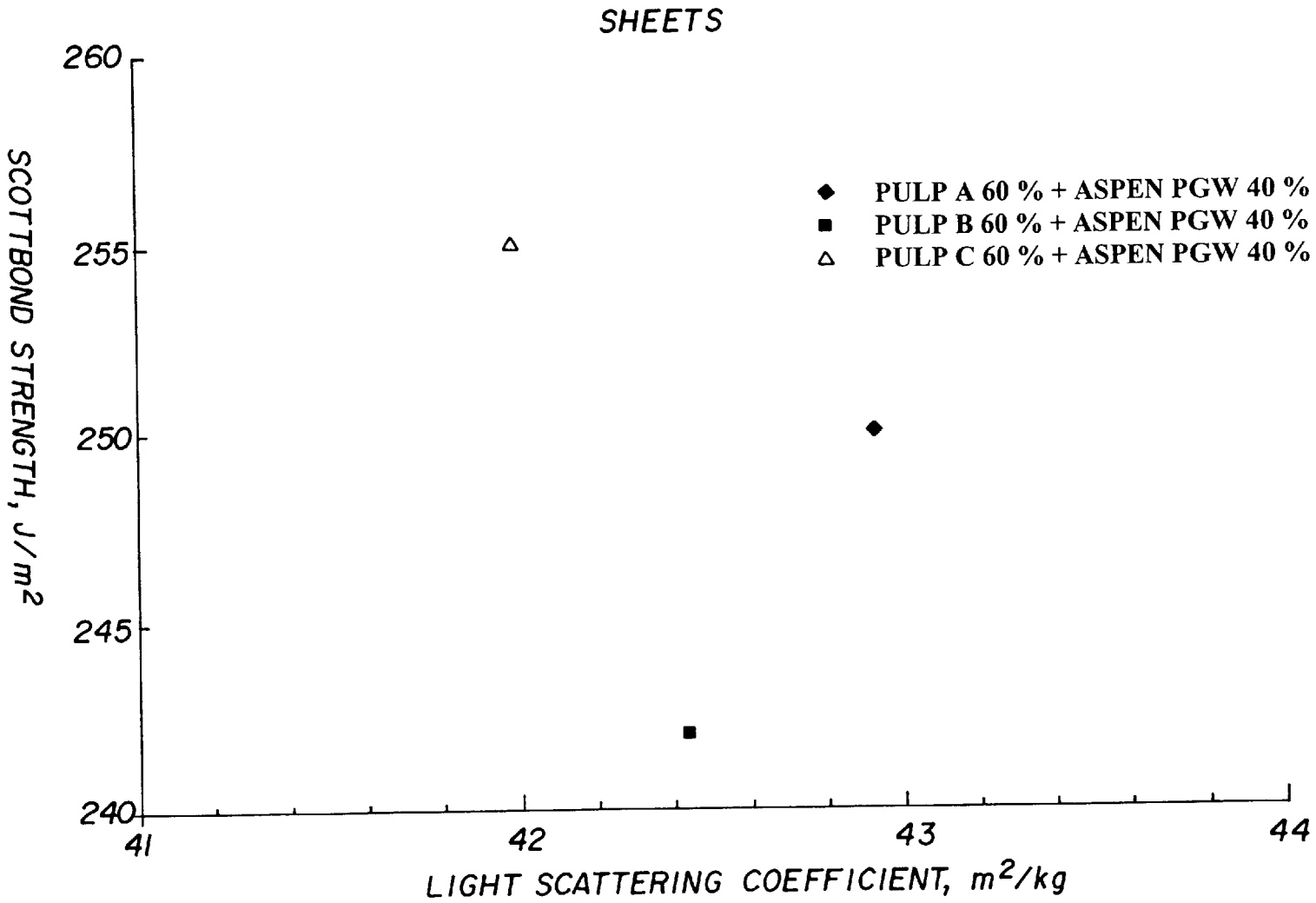

When the bonding strengths of the mixed sheets vs. light scattering coefficient now were examined, a result according to FIG. 2 was obtained. Even if the differences are rather small, it is apparent that chemical pulp A gives a better result than pulps B and C. The trend is the same as for pure pulp sheets; in other words: by the combination of batch cooking and TCF bleaching according to the present invention a better bonding strength is obtained than for the comparative pulps, even if these separately include the partial elements of the invention.

Figure 3:
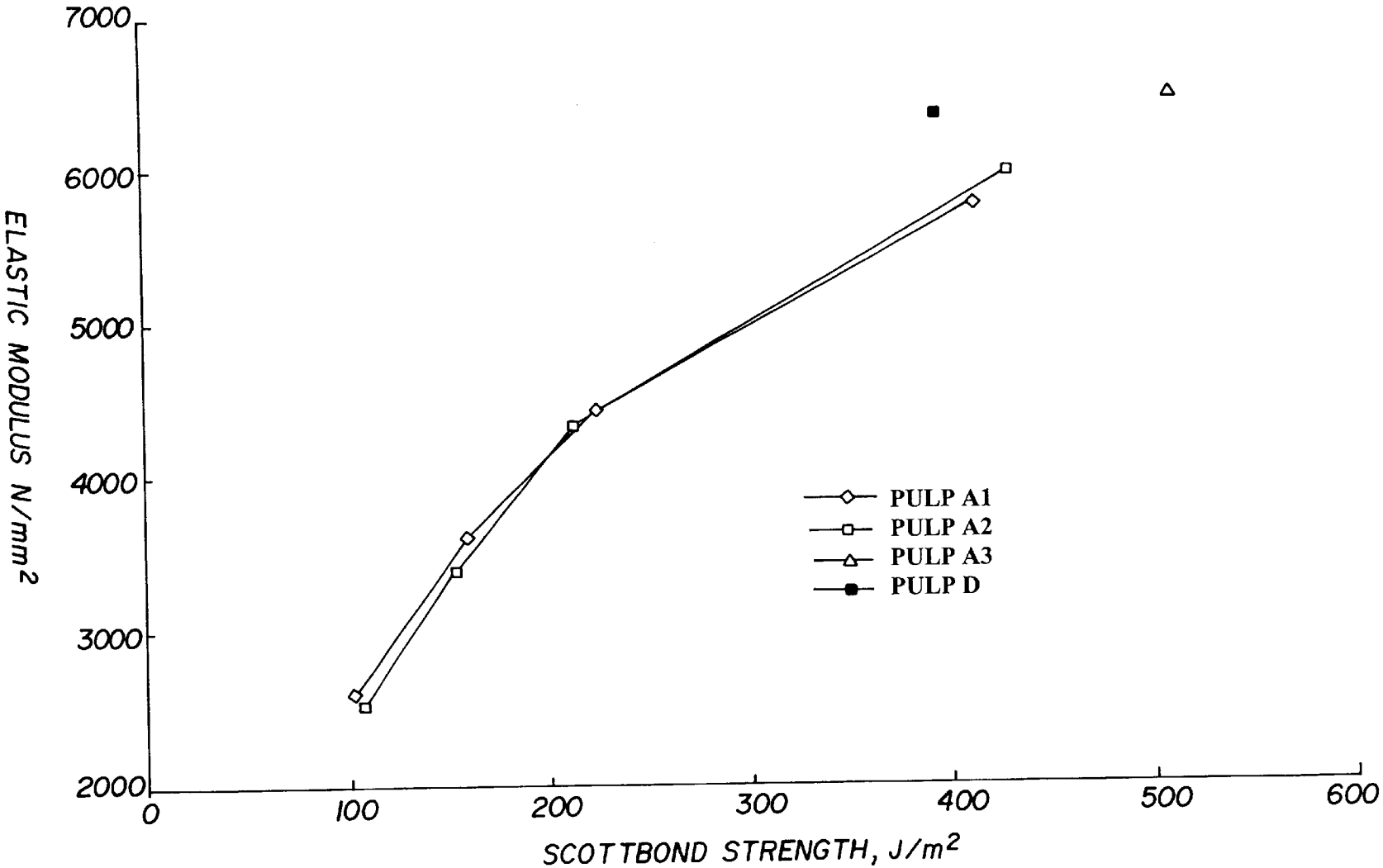

Finally, an analysis was made to determine how the elastic modulus develops as a function of ScottBond strength. This test included pulps from three production-batches (A1, A2 and A3), which corresponded to pulps 1 to 3 of FIG. 1, and a pulp sample D which corresponded to pulps 8 and 9 of FIG. 1. Pulp samples A1 and A2 had been refined to different beating degrees in a Escher-Wyss refiner and samples A3 and D again in a Valley beater. FIG. 3 shows that the elastic modulus of pulp A was smaller than for pulp D, if the comparison is carried out at the same ScottBond strength. Thus, it can be expected from the pulp A according to the invention that it gives a smaller elastic modulus than D and, accordingly, that a paper produced from pulp A is less brittle. In other words, the paper is tougher than a paper made from pulp D. The superiority of pulp A is pronounced when the pulps are beaten to a high degree of beating in order to obtain good ScottBond strength.

EXAMPLE 2

Production of a Fine Paper Containing Aspen PGW

A base paper was produced from a mechanical aspen pulp (GW) and chemical pine pulp, which were mixed at a weight ratio of 40 to 60. Ground calcium carbonate was added as a filler to the suspension in an amount of about 10% of the fibrous material.

The base paper was produced on a gap former. The properties of the base paper were the following:

| | |
|---|---|
| grammage | 53.3 g/m$^2$ |
| bulk | 1.45 cm$^3$/g |
| opacity | 88% |
| brightness | 82.5% |
| coarseness | 240 ml/min |
| porosity | 170 ml/min |
| filler content | 12% |

Comparative test carried out in connection with the invention have shown that the grammage of the base paper is at least 10% smaller than that of a base paper produced entirely from a bleached chemical pulp and having the corresponding opacity and brightness.

In order to produce the fine paper from the above-described base paper it was coated twice, first with the film press method and then with doctor blade coating.

A calcium carbonate pigment having the particle size distribution shown in Table 1 was used in the coating colours:

TABLE 1

Particle size distribution of the carbonate pigment

| Max. particle size [$\mu$m] | Cumulative proportion of weight |
|---|---|
| 5 | 99 |
| 2 | 95 |
| 1 | 70 |
| 0.5 | 35 |
| 0.2 | 10 |

The coating colour was produced in a manner known per se by mixing together the pigment, the binder and the other additives. The dry matter content of the precoating colour was 60% and of the surface coating colour 61%. The above described colours were used for coating the afore-mentioned base paper in the following conditions:

Precoating by the film press method: 9 g/m$^2$ per side; and the surface coating at a doctor blade station: 10.5 g/m$^2$ per side at a speed of 1500 m/min. The coated paper was super-calendered.

The properties of the end products were determined and compared to those of two commercially available finer papers, viz. Lumiart (Enso) and Nopacoat (Nordland Papier). The results will appear from Table 2:

TABLE 2

Optical properties of a double-coated fine paper

| | Paper according to the invention | Lumiart | Nopacoat |
|---|---|---|---|
| Grammage [g/m$^2$] | 80 | 100 | 99 |
| Bulk | 0.85 | 0.83 | 0.78 |
| Opacity [%] | 94 | 92.7 | 92.6 |
| Brightness [%] | 94 | 91 | 96.7 |
| Smoothness pps 10 [$\mu$m] | 0.8 | 1.2 | 0.8 |
| Gloss [%] | 73 | 66 | 71 |

Table 2 shows that the properties of a fine paper produced by the invention are better in all respects than those of comparative papers having corresponding bulk and grammage. Thus the yield gain on equal level of opacity is over 20%.

The ScottBond bonding strength of the fine paper prepared according to the Example was 306 J/m$^2$. This is also fully comparable to the strength of a traditional fine paper comprising only chemical pulp. Even if the internal bonding strength of aspen PGW is inferior to that of e.g. chemical birch pulp, the present invention has provided a paper which is strong enough for use as a fine paper.

What is claimed is:

1. A process for producing base paper for coated fine paper, comprising forming a stock from fibrous raw material, wherein said fibrous raw material comprises a mixture of mechanical pulp and chemical pulp, wherein said chemical pulp comprises chlorine free (TCF) bleached softwood pulp produced by batch cooking and having an elastic modulus of less than 6000 N/mm$^2$ when the bonding strength is 400 J/m$^2$, forming said stock into a web, and, drying said web to form a base paper for coated fine paper.

2. The process of claim 1, wherein said mixture of mechanical pulp and chemical pulp comprises mechanical pulp produced from hardwood and said chemical pulp comprises bleached softwood cellulosic pulp produced by batch cooking or superbatch cooking.

3. The process of claim 2, wherein said chemical pulp comprises softwood cellulosic pulp bleached with ozone and peroxide.

4. The process of claim 2, wherein said chemical pulp comprises softwood cellulosic pulp bleached with at least two ozone stages and at least two peroxide stages.

5. The process of claim 2, wherein said cellulosic pulp has a ScottBond strength of at least 400 J/m$^2$ at a light scattering coefficient of 22 m$^2$/kg and containing over 40 mequivalents of carboxylic acid groups per kg of dry pulp.

6. The process of claim 5, wherein said cellulosic pulp has a brightness of more than 82.

7. The process of claim 5, wherein said cellulosic pulp has a brightness of more than 85.

8. The process of claim 5, wherein said cellulosic pulp has a brightness of more than 88.

9. The process of claim 2, wherein said chemical pulp comprises bleached softwood cellulosic pulp produced by superbatch cooking.

10. A process for producing base paper for fine coated paper, comprising forming a stock from fibrous raw material, wherein said fibrous raw material comprises a mixture of mechanical pulp and chemical pulp, wherein said mechanical pulp is wood material from the Populus family and said chemical pulp is chlorine free (TCF) bleached softwood cellulosic pulp produced by batch cooking, wherein the amount of mechanical pulp is 20 to 70 weight-% and the amount of bleached softwood cellulosic pulp is 80 to 30 weight-% of the dry matter of the stock, wherein the chemical pulp has an elastic modulus of less than 6000 N/mm$^2$ when the bonding strength is 400 J/m$^2$, forming said stock into a web, and, drying said web to form a base paper.

11. The process of claim 10, wherein said fibrous raw material comprises a mixture of mechanical and chemical pulp wherein 30 to 60 weight-% of the dry matter of the stock formed comprises mechanical pulp and 70 to 40 weight-% of the dry matter of the stock formed comprises softwood cellulosic pulp.

12. The process of claim 11, wherein said mechanical pulp is produced from *P. tremula, P. tremuloides, P. balsamea, P. balsamifera, P. trichocarpa* or *P. heterophylla*.

13. The process of claim 12, wherein said mechanical pulp is pressure ground wood.

14. The process of claim 10 wherein said mechanical pulp is produced from *P. tremula, P. tremuloides, P. balsamea, P. balsamifera, P. trichocarpa* or *P. heterophylla*.

15. The process of claim 14, wherein said mechanical pulp is pressure ground wood.

16. A process for producing a coated fine paper, comprising coating a base paper produced by the process as in any of claims 1, 2–4, 5–11 or 15, wherein said paper is coated with two coating colour layers, the first coating being conducted by the film press method and the second by doctor blade coating.

17. The process of claim 16, wherein 5 to 50 g of coating colour/$m^2$ is applied on the web by the film press method and 10 to 60 g of coating colour/$m^2$ by doctor blade coating, the coating weights being calculated based on the dry matter of the coating colour.

* * * * *